US006684902B1

(12) United States Patent
Zinn et al.

(10) Patent No.: US 6,684,902 B1
(45) Date of Patent: Feb. 3, 2004

(54) DUAL SENSOR LIQUID ACCUMULATOR

(75) Inventors: Thomas K. Zinn, Chino Hills, CA (US); Enrique P. Loreto, Fullerton, CA (US); Ron Hahn, Yorba Linda, CA (US)

(73) Assignee: AcornVac, Inc., Chino, CA (US)

( * ) Notice: Subject to any disclaimer, the term of this patent is extended or adjusted under 35 U.S.C. 154(b) by 0 days.

(21) Appl. No.: 10/274,544

(22) Filed: Oct. 21, 2002

(51) Int. Cl.[7] ..... F16K 21/20

(52) U.S. Cl. ..... 137/393; 137/14; 137/386; 137/395; 137/396; 141/198; 222/64

(58) Field of Search ..... 73/290 R, 302, 73/303; 137/14, 205, 386, 393, 395, 396; 141/198; 222/64; 417/36, 38, 44.2

(56) References Cited

U.S. PATENT DOCUMENTS

| | | | | | |
|---|---|---|---|---|---|
| 1,511,432 | A | * | 10/1924 | Skidmore | 417/38 |
| 2,956,581 | A | * | 10/1960 | Pearson | 417/38 |
| 3,360,002 | A | * | 12/1967 | Weis et al. | 137/395 |
| 3,393,642 | A | * | 7/1968 | Kordik et al. | 417/36 |
| 3,470,902 | A | * | 10/1969 | Hackman | 137/386 |
| 3,573,015 | A | * | 3/1971 | Canfield et al. | 137/403 |
| 3,775,026 | A | * | 11/1973 | Hewlings | 417/36 |
| 4,202,367 | A | * | 5/1980 | Roth et al. | 137/393 |
| 4,203,462 | A | * | 5/1980 | Beller | 137/393 |
| 4,258,745 | A | * | 3/1981 | Nicholson | 137/403 |
| 4,336,825 | A | * | 6/1982 | Pion | 137/403 |
| 4,522,228 | A | * | 6/1985 | Campau | 137/393 |
| 4,603,709 | A | * | 8/1986 | Huisma | 137/205 |
| 4,607,658 | A | * | 8/1986 | Fraser et al. | 137/393 |
| 5,615,701 | A | * | 4/1997 | Yamabe et al. | 137/205 |
| 5,871,027 | A | * | 2/1999 | Shimizu et al. | 137/205 |
| 5,969,619 | A | * | 10/1999 | Niemiro et al. | 137/393 |
| 6,305,403 | B1 | | 10/2001 | von Palffy et al. | |
| 6,311,718 | B1 | | 11/2001 | Hafner et al. | |
| 6,349,425 | B1 | | 2/2002 | Stradinger et al. | |
| 6,353,942 | B1 | | 3/2002 | Pondelick et al. | |
| 6,370,709 | B1 | | 4/2002 | Stradinger et al. | |
| 6,385,789 | B1 | | 5/2002 | Pondelick et al. | |

OTHER PUBLICATIONS

US 6,311,717, 11/2001, Stradinger et al. (withdrawn)

* cited by examiner

*Primary Examiner*—George L. Walton
(74) *Attorney, Agent, or Firm*—Edgar W. Averill, Jr.

(57) ABSTRACT

An accumulator for collecting a volume of a liquid, which includes controls to permit the liquid to rise in a container to a preset upper level, at which level a drain valve is opened causing liquid to flow out of the accumulator. The accumulator utilizes two opened bottom pipes, which are connected through check valves to a controller. The controller is sensitive to the pressure at its inlet port. The pipes are interconnected so that when the liquid reaches an upper level, the pressure at the controller is sufficient to open the drain valve, and once the accumulator is almost empty, the drain valve is closed.

12 Claims, 3 Drawing Sheets

DUAL SENSOR LIQUID ACCUMULATOR

BACKGROUND OF THE INVENTION

The field of the invention is plumbing fixtures and the invention relates more particularly to piping a control system for permitting the accumulation of water or other liquids in a box and emptying the accumulated liquid when the box is full.

A pressure sensitive controller is shown in U.S. Pat. No. 6,311,718, assigned to the assignee of the present invention. The specification and drawings of this patent are incorporated by reference herein for purposes of background. A waste disposal system is shown in U.S. Pat. No. 6,385,789, which utilizes a vacuum operated discharge valve. The system utilizes an electrically operated control valve and is operated by depressing a flush button.

U.S. Pat. No. 6,349,425 also shows a vacuum toilet system. The unit is operated in response to a flush command. The same unit is shown in U.S. Pat. Nos. 6,353,942 and 6,370,709. A vacuum drainage system is shown in U.S. Pat. No. 6,305,403. A buffer box used in a vacuum drainage system is shown in U.S. Pat. No. 6,311,717.

BRIEF SUMMARY OF THE INVENTION

It is an object of the present invention to provide an accumulator box which will empty liquid from the accumulator box when the liquid reaches a predetermined level without the use of any electrical signal.

The present invention is for an accumulator for collecting a volume of a liquid, including means for removing the liquid when the liquid reaches a predetermined level in the accumulator. The accumulator has a box for holding a volume of liquid and the box has an outlet port near its bottom for passing liquid out of the box. An inlet opening allows liquid to pass into the box and to be accumulated in the box. A first control pipe is held within the interior of the box and has an open bottom near the bottom of the box and has a closed top. A second control pipe is also held within the interior of the box and has an open bottom spaced further away from the bottom of the box than the open bottom of the first control pipe. A conduit passes from the closed top of the first control pipe to the inlet port of a pressure sensitive controller. The first conduit has a first check valve permitting the flow of gas only in the direction of the first control pipe. A second conduit leads from the closed top of the second control pipe to a point where it joins the first conduit at a location in the first conduit between the first check valve and the inlet port of the pressure sensitive controller. The second conduit has a second check valve therein permitting the flow of gas only in the direction of the pressure sensitive controller. As the level of liquid rises in the box, it initially increases the air pressure within the first control pipe, but the first check valve prevents this increase in pressure from passing to the inlet of the pressure sensitive controller. As the liquid level rises further, it reaches the open bottom of the second control pipe. As the pressure within the second control pipe increases, this increase in pressure is passed to the inlet port of the pressure sensitive controller. When the level of liquid has reached a predetermined distance above the open bottom of the second control pipe, the pressure is sufficient to actuate the pressure sensitive controller, thereby opening a drain valve and emptying the contents of the box. The present invention is also for the process of operating the accumulator. The drain valve is closed when the liquid level drops below the bottom of the first control pipe.

DESCRIPTION OF THE PREFERRED EMBODIMENTS

Figure 1:
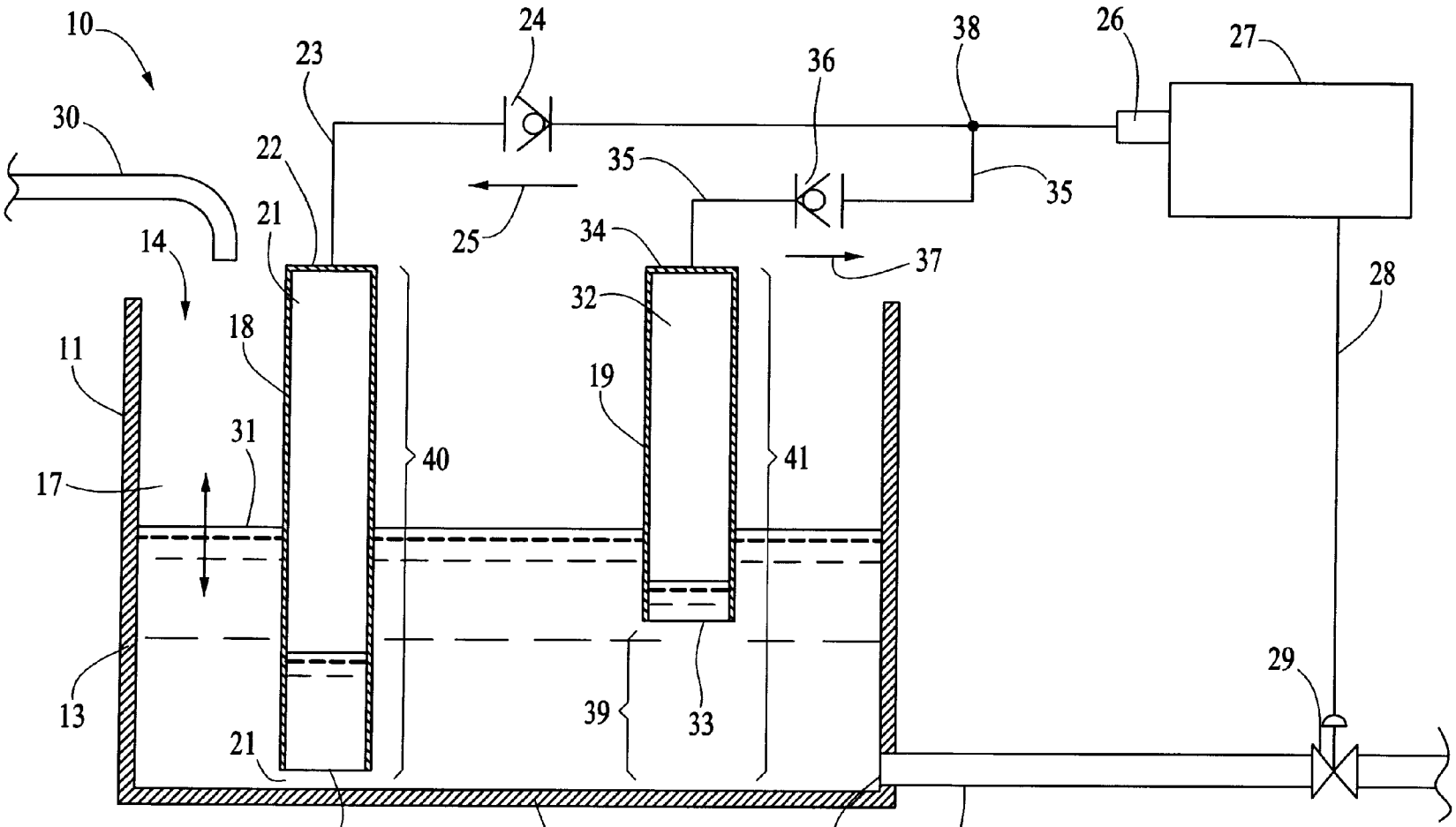
FIG. 1 is a diagrammatic view of the accumulator of the present invention.

The accumulator of the present invention is shown in diagrammatic view in FIG. 1 and indicated generally by reference character 10. Accumulator 10 has a box or receptacle 11, which is typically a stainless steel rectangular box. Box 11 has a bottom 12, sides 13, and a top 14. Box 11 has an outlet drain line 15 affixed over an outlet opening 16 adjacent the bottom 12 of box 11. The word "adjacent" is intended to include an outlet in bottom 12 itself, as well as along the side, either at the bottom or a short distance from the bottom. Furthermore, the outlet drain line could extend into the interior volume 17 of the accumulator. Thus, the important feature is that the outlet drain line 15 be connected to box 11 such that the imposition of a vacuum in line 15 will cause the liquid contents of box 11 to be largely removed from the interior volume 17.

A pair of control pipes comprising a first control pipe 18 and a second control pipe 19, are positioned largely within the interior volume 17 of box 11. First control pipe has an open bottom 20 which is positioned a first distance 21 from the bottom 12 of the box 11. Control pipe 18 has a first interior space 21 and a closed top 22. A first conduit 23 is connected in an airtight manner to closed top 22 and permits air or whatever gas the accumulator is positioned within to pass from the first interior space 21 into the first conduit 23. A first check valve 24 is positioned in first conduit 23 and permits the flow of air in the direction of arrow 25 toward the first interior space 21. It, of course, prevents the flow of air out of interior space 21.

First conduit 23 continues from first check valve 24 and is connected to the inlet port 26 of a pressure sensitive controller 27.

Pressure sensitive controller 27 may be of the type shown in U.S. Pat. No. 6,311,718, however any other pressure sensitive controller with sufficient sensitivity can be used. The pressure sensitive controller is preferably of the type which may be adjusted to output a signal when the pressure at the inlet port reaches a predetermined level. For instance, the controller 27 can be set so that when the pressure at inlet port 26 reaches two inches of water, a signal is initiated through line 28 to control valve 29. When control valve 29 is opened, a vacuum is pulled on outlet drain line 15 as long as control valve remains open. The pressure sensitive controller typically is set so that when the pressure at inlet port 26 reaches 0, the signal is discontinued through line 28 turning off control valve 29. of course when the term "pressure" is used herein, it is intended to indicate gauge pressure and not absolute pressure. It is also to be understood that the controller 27 could be set so that when the pressure at the inlet port reaches, for instance ¼ of an inch of water, the signal through line 28 is discontinued.

When the pressure sensitive control valve indicated above is utilized, it is not necessary that any source of electricity be utilized in the elements shown in FIG. 1, since they are all controlled by air pressure and vacuum.

Figure 3:
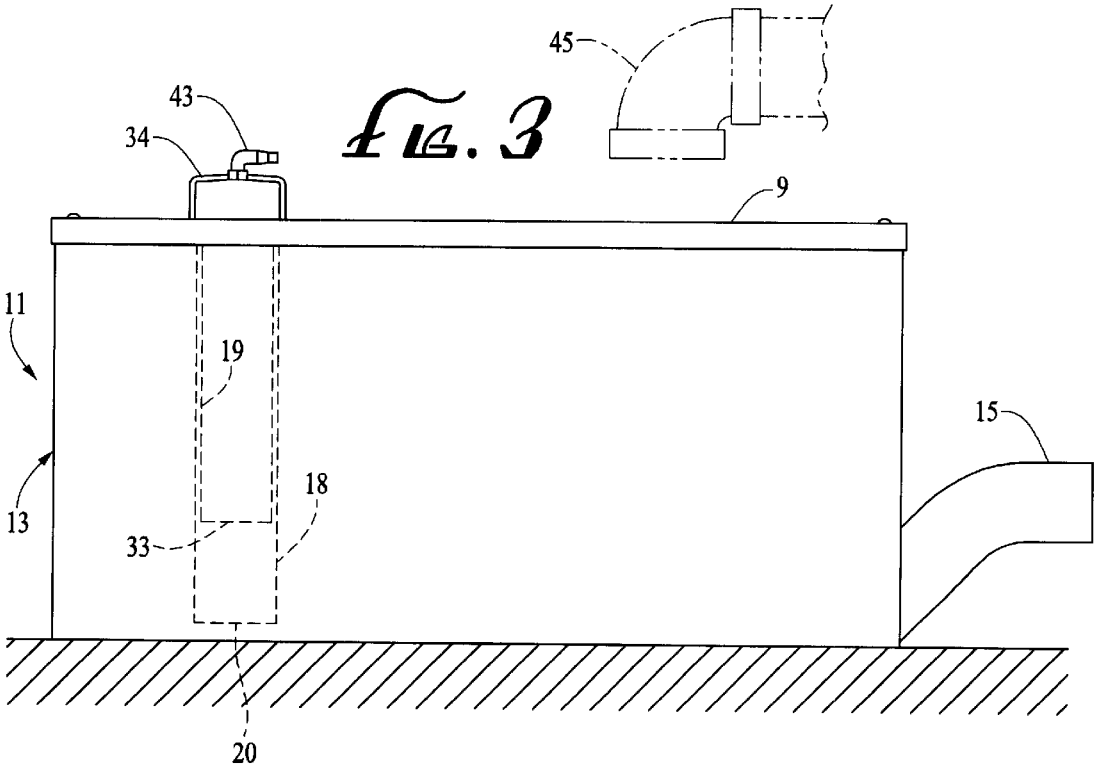
FIG. 3 is a side view thereof.

A liquid inlet line 30 provides a source of water or other liquid. This source might be the condensate from a refrigeration system or from some other source which causes the liquid level 31 to increase until the drain signal is received. Top cover 9 has an inlet opening 44 over which a source of liquid, such as sink drain 45 shown in phantom view in FIG. 3, is positioned).

The second control pipe 19 has a second interior space 32, an open bottom 33, and a closed top 34. A second conduit 35 is connected to closed top 34 to pass air or other gas from second interior space 32 into second conduit 35.

Second conduit 35 has a second check valve 36 which permits air to flow only in the direction of arrow 37 out of second interior space 32. Second conduit 35 continues to a connection tee 38. This connects second conduit 35 to first conduit 23 between first check valve 24 and inlet port 26.

The open bottom 33 of second control pipe 19 is positioned a third distance 39 from bottom 12. Third distance 39 is greater than first distance 21 for reasons discussed below. Closed top 22 is spaced a second distance 40 from bottom 12 and closed top 36 is separated a fourth distance 41 from bottom 12.

Figure 2:
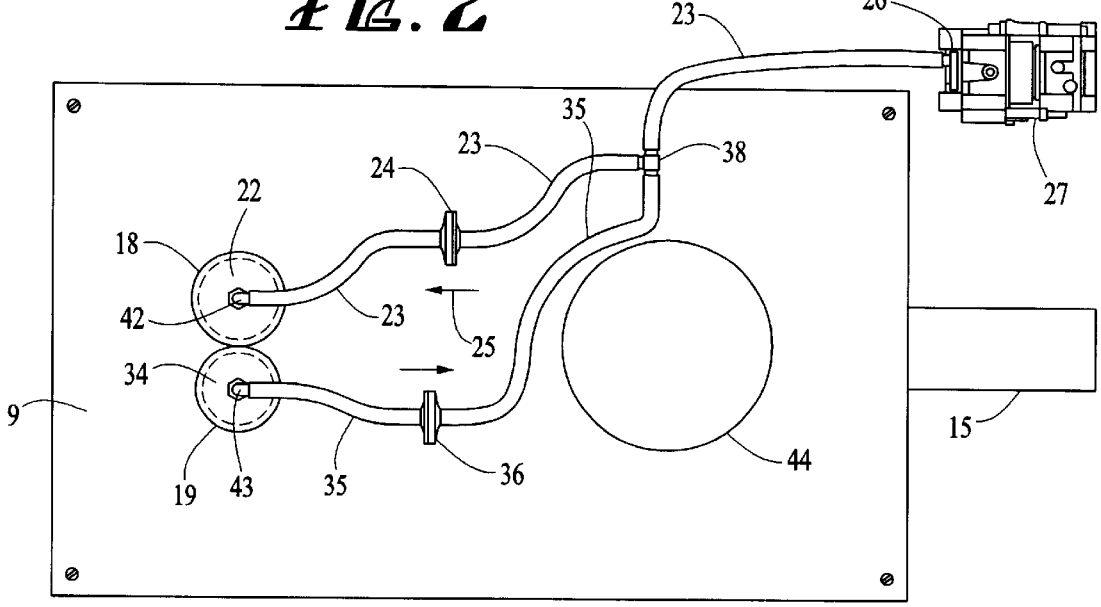
FIG. 2 is a top view thereof.

The diagrammatic view of FIG. 1 is shown in top view in FIG. 2. Control pipes 18 and 19 are shown with their respective closed tops 22 and 34. An outlet port 42 leads through closed top 22 into first conduit 23. Similarly, outlet port 43 leads through closed top 34 into second conduit 35.

Turning to FIG. 3, box 11 is shown in side view and control pipes 18 and 19 are shown in phantom view with their bottoms 20 and 33, respectively, also being indicated in phantom view. Details of the outlet port 43 are shown as are details of the closed top 34.

The operation of the accumulator can be understood best from a description of air pressures at various liquid levels indicated in FIGS. 4A through 4E. Pressure will be indicated in the discussion in units of inches of water, although of course, if other liquids are being accumulated, the units would be inches of whatever liquid is being accumulated.

Figures 4A, 4B, 4C, 4D, 4E:
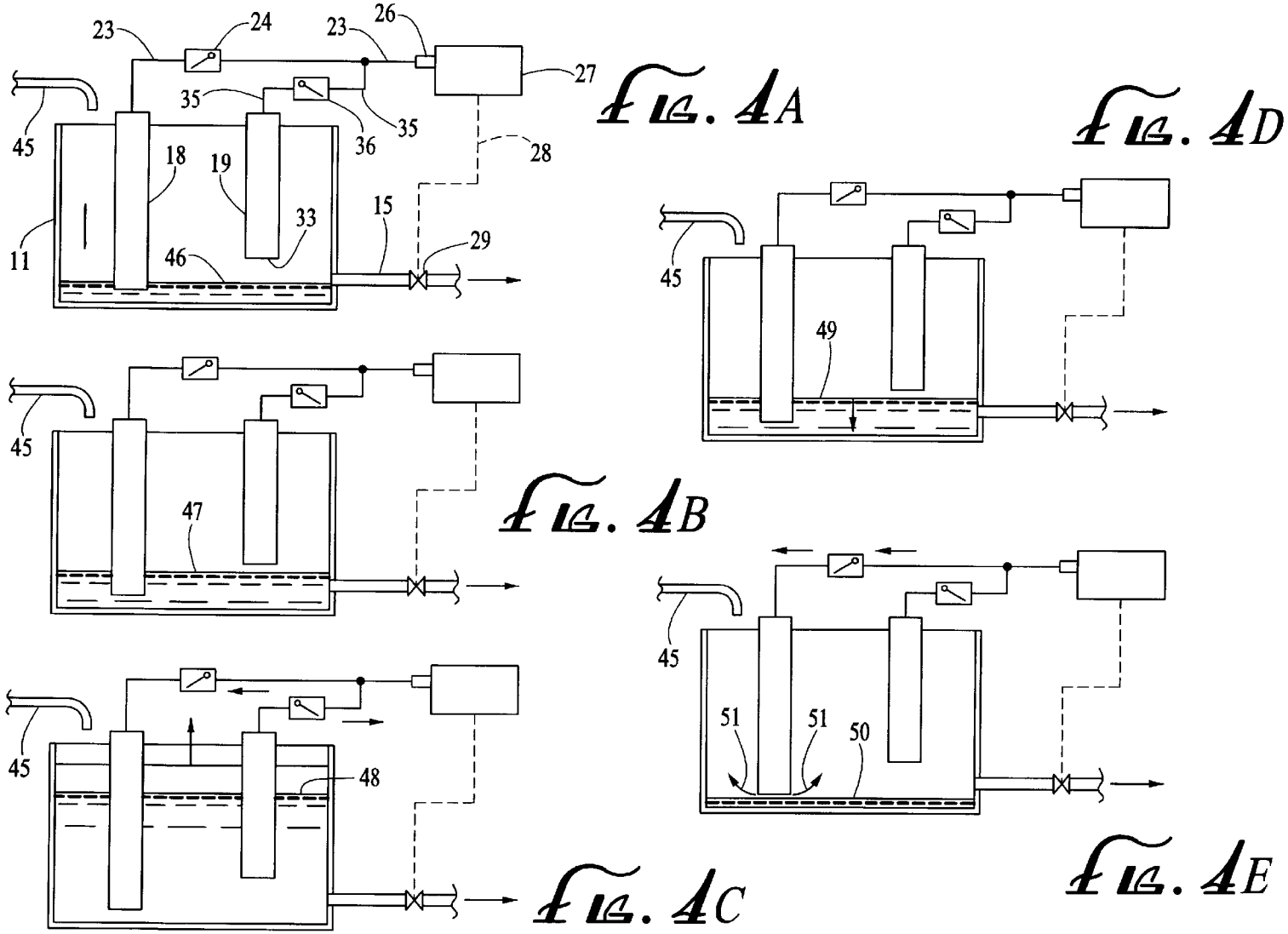
FIG. 4A is a diagrammatic view thereof, showing the liquid level at a lowermost position.
FIG. 4B is a diagrammatic view thereof, showing the liquid level increased from that shown in FIG. 4A.
FIG. 4C is a diagrammatic view thereof, showing the liquid level increased to a further height, as compared to that shown in FIG. 4B.
FIG. 4D is a diagrammatic view thereof, showing the liquid level decreasing.
FIG. 4E is a diagrammatic view thereof, showing the liquid level at the end of the draining step.

As liquid enters through sink drain 45, the water level within box 11 rises to that shown in FIG. 4A and indicated by reference character 46. Water level 46 is above the bottom 20 of control pipe 18 and, thus, a small amount of pressure builds up in that portion of line 23 which is between first check valve 24 and control pipe 18, as well as in the control pipe interior space 21. Because check valve 24 does not permit the flow of gas out of control pipe 18, the pressure in that portion of line 23 between check valve 24 and inlet port 26 remains at 0 atmospheric pressure.

As shown in FIG. 4B, as the water level continues to increase, the pressure in control pipe 18 in the portion of conduit 23 up to check valve 24 also increases to, for instance, four inches, whereas the pressure in line 23 after check valve remains at atmospheric pressure. The water level in FIG. 4B is indicated by reference character 47 and is still below the bottom 33 of control pipe 19.

Turning now to FIG. 4C, the water level 48 has risen above the open bottom 33 of control pipe 19 and causes the pressure in second conduit 35 to increase to two inches, since the air which is being compressed within control pipe 19, will pass through second check valve 36. This causes the pressure from first check valve 24 to the inlet 26 of controller 27 and in that portion of conduit 35 between check valve 36 and conduit 23 all to rise to two inches. Assuming that this is the set pressure of controller 27, a signal is sent through line 28 to open drain valve 29 and cause the water level to drop as indicated in FIG. 4D, first to a position below the bottom 33 of second control pipe 19. Since the second check valve 36 maintains the pressure of two inches-in conduit 23, the signal continues to be sent to valve 29 to continue the draining of water out of outlet drain line 15. Thus, when the water level 49 falls below bottom 33, there is no effect on the pressure at the inlet 26 of controller 27.

However, when the water level reaches that shown by reference character 50 in FIG. 4E, air can escape, as indicated by arrows 51 into the atmosphere. Since first check valve 24 permits the pressure in line 23 to pass through it to the lower pressure or atmospheric pressure within first control pipe 18, the controller 27 turns off the signal through line 28, thereby shutting off control valve 29 and preparing the accumulator for a new collection cycle.

Obviously, the length of the control pipes can be adjusted to provide the desired upper and lower levels of liquid within box 11. It is important that the first distance 21 between the open bottom 20 and bottom 12 is less than the distance 39 between open bottom 33 and bottom 12. Typically, the second and fourth distances 40 and 41, respectively, would be the same, although this is not essential. It is also preferred that the third distance 39 be less than half of the second distance 40, so that sufficient pressure and volume can build up in the second interior space 22 and second conduit 35, so that there will be sufficient pressure and volume transferred to interior space 21 to empty the interior space and permit air to enter open bottom 20.

For a box having a height of 12 inches, one example of a set of useful distances are as follows:

First distance—½ inch

Second distance 14 inches

Third distance 4 inches

Fourth distance 14 inches.

A useful control pipe size has been 1½ inch PVC pipe with a cap. Obviously, the dimensions would be dependent upon the size of box 11.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. An accumulator for collecting a volume of a liquid including means for removing the liquid when the liquid reaches a predetermined level in the accumulator, said accumulator comprising:

a box for holding said volume of liquid, said box having a bottom, and sides defining an interior box volume, and a top;

an outlet port leading from said box positioned adjacent the bottom of said box, said outlet port being connected to an outlet line having means for causing said liquid to pass outwardly from said box;

an inlet opening configured to allow liquid to pass into and to be accumulated in said interior volume of said box;

a first control pipe held with at least a portion thereof within said interior volume of said box, said first control pipe having an open bottom at a first distance from the bottom of said box and a closed top located a second distance from the bottom of said box, said second distance being greater than said first distance and said first control pipe having a first interior space;

a second control pipe held with at least a portion thereof within said interior volume of said box, said second control pipe having an open bottom at a third distance from the bottom of said box and a closed top located a fourth distance from the bottom of said box, said fourth distance being greater than said third distance and said third distance being greater than said first distance and said second control pipe having a second interior space;

a first conduit leading from said closed top of said first control pipe to an inlet port of a pressure sensitive controller, said first conduit having a first check valve therein permitting the flow of gas only in the direction of said first control pipe, said pressure sensitive controller being of the type which sends a signal when the pressure at its inlet port reaches a desired upper pressure and sends no signal when the pressure at the inlet port reaches a desired lower pressure;

a second conduit leading from said closed top of said second control pipe to said first conduit at a location in said first conduit between said first check valve and said inlet port of said pressure sensitive controller, said second conduit having a second check valve therein permitting the flow of gas only in the direction of said pressure sensitive controller;

whereby as a level of liquid rises in said box above said first distance the pressure in the first interior space increases and as said level of liquid continues to rise in said box, the pressure in said first interior space continues to increase and when the level of liquid exceeds said third distance the pressure in the second interior space increases thereby increasing the pressure in the first conduit downstream of said first check valve which passes said increase in pressure to said inlet port of said pressure sensitive controller which is set to open when the pressure at said inlet port of said pressure sensitive controller reaches a desired pressure at which desired pressure said means for causing liquid to pass outwardly from said box is activated causing the liquid level in said box to decrease until it reaches said first distance at which point the pressure in said interior space in said first conduit decreases to zero thereby causing the pressure at the inlet port of said pressure sensitive controller to reach zero and to close said means for causing liquid to pass outwardly from said box thereby permitting the box to accumulate additional liquid.

2. The accumulator of claim 1 wherein said first and second control pipes are mounted vertically.

3. The accumulator of claim 1 wherein said box has a cover which supports said first and second control pipes.

4. The accumulator of claim 1 wherein said means for causing said liquid to pass outwardly from said box comprises a source of a partial vacuum introduced into said outlet line.

5. The accumulator of claim 1 wherein said desired lower pressure is zero.

6. The accumulator of claim 1 wherein said second distance and said fourth distance are equal.

7. The accumulator of claim 1 wherein said third distance is less than one half the second distance.

8. A process for maintaining a range of liquid level in a receptacle having a top and a receptacle bottom and an interior volume comprising:

placing at least a lower portion of a first control pipe having a first pipe open bottom and a first pipe closed top in said interior volume of said receptacle so that the first pipe open bottom is a first distance from said receptacle bottom and said first pipe closed top is a second distance from said receptacle bottom and said first control pipe having a first interior space;

connecting a first conduit line between said first pipe closed top and to an inlet port of a pressure sensitive controller;

setting said pressure sensitive controller to activate a drain valve when the air pressure at its inlet port reaches a desired upper pressure and to deactivate said drain valve when the air pressure at said inlet port reaches a desired lower pressure;

placing a first check valve in said first conduit line which permits the flow of air only in the direction of said first interior space;

placing at least a lower portion of a second control pipe having a second pipe open bottom and a second pipe closed top in said interior volume of said receptacle so that the second pipe open bottom is a third distance from said receptacle bottom and said second pipe closed top is a fourth distance from said receptacle bottom and said second control pipe having a second interior space and said third distance is greater than said first distance and said fourth distance is greater than said third distance;

connecting a second conduit line between said second pipe closed top and said first conduit line between said first check valve and said inlet port of said pressure sensitive controller;

placing a second check valve in said second conduit line between said second closed top and said first conduit line which permits the flow of air only in the direction of said pressure sensitive controller;

placing an outlet line leading from said receptacle adjacent the bottom of said receptacle to drain liquid from said receptacle and positioning an outlet valve controlled by said pressure sensitive controller in said outlet line;

whereby when a flow of liquid passes into said interior volume of said receptacle and rises beyond said third distance, the pressure at the inlet port increases to said desired upper pressure, the pressure sensitive controller activates said drain valve and as the liquid level lowers below said first distance the pressure at the inlet port decreases to said desired lower pressure thereby deactivating said drain valve.

9. The process of claim 8 wherein said first distance is adjacent the bottom of said receptacle.

10. The process of claim 9 wherein said third distance is less than half of said fourth distance.

11. The process of claim 8 wherein said desired upper pressure is about two inches of water.

12. The process of claim 8 wherein said desired lower pressure is zero.

* * * * *